US005564524A

United States Patent [19]

Thaggard et al.

[11] Patent Number: 5,564,524

[45] Date of Patent: Oct. 15, 1996

[54] FOLDING LADDER TREE STAND

[76] Inventors: Marty R. Thaggard, R.R. 2 Box 183, Sturgis, Miss. 39769; James H. Estes, Rte. 2 Box 322-A, Louisville, Miss. 39339

[21] Appl. No.: 306,960

[22] Filed: Sep. 16, 1994

[51] Int. Cl.[6] ..... A47F 3/00

[52] U.S. Cl. ..... 182/116; 182/187

[58] Field of Search ..... 182/116, 115, 182/187, 188, 133, 135, 138, 164; 108/156

[56] References Cited

U.S. PATENT DOCUMENTS

| | | | |
|---|---|---|---|
| 4,579,198 | 4/1986 | Lee | 182/115 |
| 4,787,476 | 11/1988 | Lee | 182/116 |
| 5,016,732 | 5/1991 | Dunn | 182/116 |
| 5,105,908 | 4/1992 | Freund | 182/116 X |
| 5,195,611 | 3/1993 | Untz | 182/116 X |
| 5,253,732 | 10/1993 | Daniels | 182/116 |
| 5,267,632 | 12/1993 | Mintz | 182/116 |
| 5,275,257 | 1/1994 | Robertson | 182/116 |
| 5,332,063 | 7/1994 | Amacker | 182/116 |

*Primary Examiner*—Karen J. Chotkowski

[57] ABSTRACT

A folding ladder tree stand comprising a ladder having a runged upper section and a separate runged lower section; a coupling mechanism for pivotally coupling the upper section with the lower section such that they are generally alignable for placing the ladder in an operable configuration and proximately positionable for placing the ladder in a stowed configuration; a collapsible chair pivotally coupled to the upper section of the ladder and positionable above the upper section in an operable configuration and proximately positionable therewith in a stowed configuration; and a securement mechanism adapted for securing the chair to a tree with the chair and ladder in operable configurations for use and for securing the chair and ladder in their stowed configurations for transport.

1 Claim, 3 Drawing Sheets

FOLDING LADDER TREE STAND

BACKGROUND OF THE INVENTION

1. Field of the Invention

The present invention relates to a folding ladder tree stand and more particularly pertains to providing a hunter an elevated stationary support for hunting with a folding ladder tree stand.

2. Description of the Prior Art

The use of tree stands is known in the prior art. More specifically, tree stands heretofore devised and utilized for the purpose of providing a stationary support for hunting are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,129,198 to Hunter discloses a pole seat and ladder. U.S. Pat. No. 4,742,888 to Amacker discloses a folding ladder stand. U.S. Pat. No. 5,242,030 to Lobozzo discloses a deer stand. U.S. Pat. No. 5,253,732 to Daniels discloses a portable folding tree stand. U.S. Pat. No. 5,267,632 to Mintz discloses a folding deer stand apparatus.

While these devices fulfill their respective, particular objective and requirements, the aforementioned patents do not describe a folding ladder tree stand that provides an elevated stationary support for hunting, provides a way to readily access this elevated stationary support, and provides a structure that can be readily placed in an operable configuration for use or a stowed configuration for transport.

In this respect, the folding ladder tree stand according to the present invention substantially departs from the conventional concepts and designs of the prior art, and in doing so provides an apparatus primarily developed for the purpose of providing a hunter an elevated stationary support for hunting.

Therefore, it can be appreciated that there exists a continuing need for new and improved folding ladder tree stand which can be used for providing a hunter an elevated stationary support for hunting. In this regard, the present invention substantially fulfills this need.

SUMMARY OF THE INVENTION

In the view of the foregoing disadvantages inherent in the known types of tree stands now present in the prior art, the present invention provides an improved folding ladder tree stand. As such, the general purpose of the present invention, which will be described subsequently in greater detail, is to provide a new and improved folding ladder tree stand and method which has all the advantages of the prior art and none of the disadvantages.

To attain this, the present invention essentially comprises, in combination, a ladder. The ladder includes an upper section having an elongated horizontal pivot rod with a pair of free ends. The upper section of the ladder includes a pair of front legs each having a top end, a bottom end, an intermediate location therebetween, a top segment, and a bottom segment with the top segment coupled to a separate free end of the pivot rod and extended angularly downwards therefrom to the intermediate location and the bottom segment extended vertically downwards from the intermediate location to the bottom end. The upper section of the ladder includes a pair of back legs each having a top end, a bottom end with a pin hole formed thereon, an intermediate location therebetween, a top segment, and a bottom segment with the top segment coupled to a separate free end of the pivot rod and extended angularly downwards therefrom to the intermediate location, with the top segment of the back leg and the corresponding top segment of the front leg forming a pointed arch, and the bottom segment extended vertically downwards from the intermediate location to the bottom end. The upper section of the ladder includes a plurality of spaced horizontal rungs with each rung having a major segment coupled between the front legs and a pair of opposed minor segments each perpendicularly positioned with respect to the major segment and each coupled between a separate front leg and corresponding back leg.

The ladder also includes a lower section. The lower section includes a pair of spaced and vertical front legs each having a top end and a bottom end with a pin extended downwards therefrom, each top end pivotally coupled to a separate bottom end of a front leg of the upper section. The lower section includes a pair of spaced back legs each having a top end with a pin hole formed thereon, a bottom end coupled to a separate front leg at a location above its pin, an intermediate location therebetween, a top segment, and a bottom segment with the top segment extended vertically downwards from the top end to the intermediate location, and a bottom segment extended angularly downwards from the intermediate location to the bottom end. The lower section includes a plurality of spaced horizontal rungs with each rung having a major segment coupled between the front legs and a pair of opposed minor segments each perpendicularly positioned with respect to the major segment and each coupled between a separate front leg and corresponding back leg.

Lastly, the ladder includes a pair of quick-disconnect pins. The pins are insertable through the aligned pin holes of two pairs of corresponding back legs of the upper section and the lower section for placing the ladder in an operable configuration. The pins are removable from the pin holes such that the upper section is positionable within proximity of the lower section for placing the ladder in a stowed configuration.

A chair is also provided. The chair includes a horizontal lower frame having front, rear, and opposed sides and further having a first pair of collars and a second pair of collars. Each collar of the first pair is extended outwards from the front of the lower frame and pivotally coupled to the pivot rod of the ladder. Each collar of the second pair is extended outwards from a separate side of the lower frame. The chair includes a rectangular platform secured upon the lower frame. The chair includes a generally U-shaped upper frame having a cross-leg and a pair of long legs extended angularly upwards therefrom and with each long leg terminated at a free end. The upper frame further includes a pair of spaced collars extended angularly downwards from the cross leg and pivotally coupled to the pivot rod of the ladder. The chair includes a seat formed of an upper seat segment and a lower seat segment with each seat segment extended between the long legs of the frame, a pair of support segments with each support segment having one end coupled to the midpoint of the upper seat segment and another end coupled to a long leg of the upper frame, and generally a canvas sheet extended between the seat segments to thereby define a concave portion for sitting. Lastly, the chair includes a pair of spaced bracing segments each having an upper end removably coupled to a separate long leg of the frame at a location adjacent to an upper seat segment, a lower end coupled to the upper section of the ladder, and an intermediate portion extended therebetween and through a separate collar of the second pair. The upper ends of the bracing segments are coupled to the frame to thereby place the chair in an operable configuration. The upper ends of the bracing segments are decoupled from the frame such that the chair is collapsible and positionable in proximity with the upper section of the ladder in a stowed configuration.

Lastly, a coupling mechanism is included and has an openable pivotable turnbuckle coupled to a free end of the frame and a chain having a first end extended from the turnbuckle and a second end pivotally coupled to the other free end of the frame. The coupling mechanism is adapted to be coupled about a tree for placing the chair and ladder in their operable configurations for use. The coupling mechanism is also coupleable about the upper section and lower section of the ladder for securing the chair and ladder in their stowed configurations for transport.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved folding ladder tree stand which has all the advantages of the prior art tree stands and none of the disadvantages.

It is another object of the present invention to provide a new and improved folding ladder tree stand which may be easily and efficiently manufactured and marketed.

It is a further object of the present invention to provide a new and improved folding ladder tree stand which is of durable and reliable construction.

An even further object of the present invention is to provide a new and improved folding ladder tree stand which is susceptible of a low cost of manufacture with regard to both materials and labor, and which accordingly is then susceptible of low prices of sale to the consuming public, thereby making such a folding ladder tree stand economically available to the buying public.

Still yet another object of the present invention is to provide a new and improved folding ladder tree stand which provides in the apparatuses and methods of the prior art some of the advantages thereof, while simultaneously overcoming some of the disadvantages normally associated therewith.

Even still another object of the present invention is to provide a new and improved folding ladder tree stand for providing a hunter an elevated stationary support for hunting.

Lastly, it is an object of the present invention to provide a new and improved folding ladder tree stand comprising a ladder having a runged upper section and a separate runged lower section; coupling means for pivotally coupling the upper section with the lower section such that they are generally alignable for placing the ladder in an operable configuration and proximately positionable for placing the ladder in a stowed configuration; a collapsible chair pivotally coupled to the upper section of the ladder and positionable above the upper section in an operable configuration and proximately positionable therewith in a stowed configuration; and securement means for adapted for securing the chair to a tree with the chair and ladder in operable configurations for use and for securing the chair and ladder in their stowed configurations for transport.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
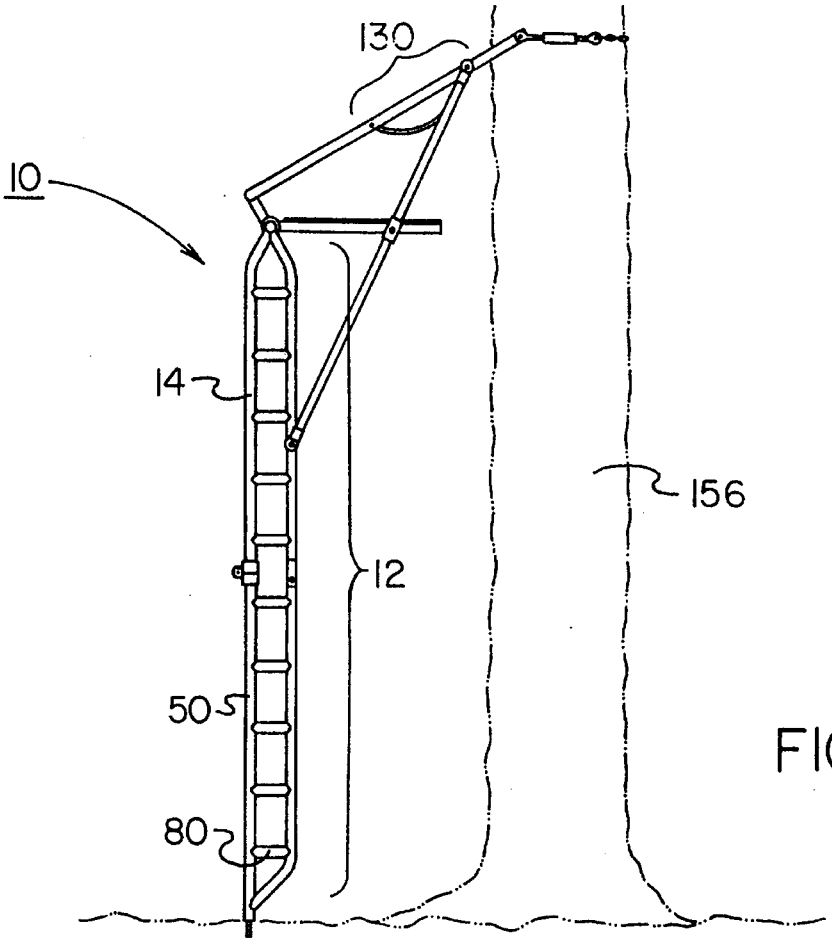
FIG. 1 is a side-elevational view of the preferred embodiment constructed in accordance with the principles of the present invention secured to a tree and the ground therebelow in an operable configuration.
Figure 2:
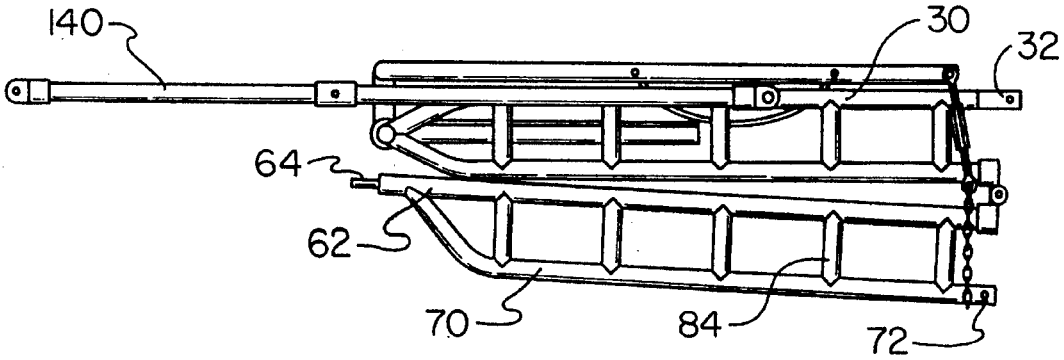
FIG. 2 is yet another side-elevational view of the present invention placed in a stowed configuration for transport from one location to another.
Figure 3:
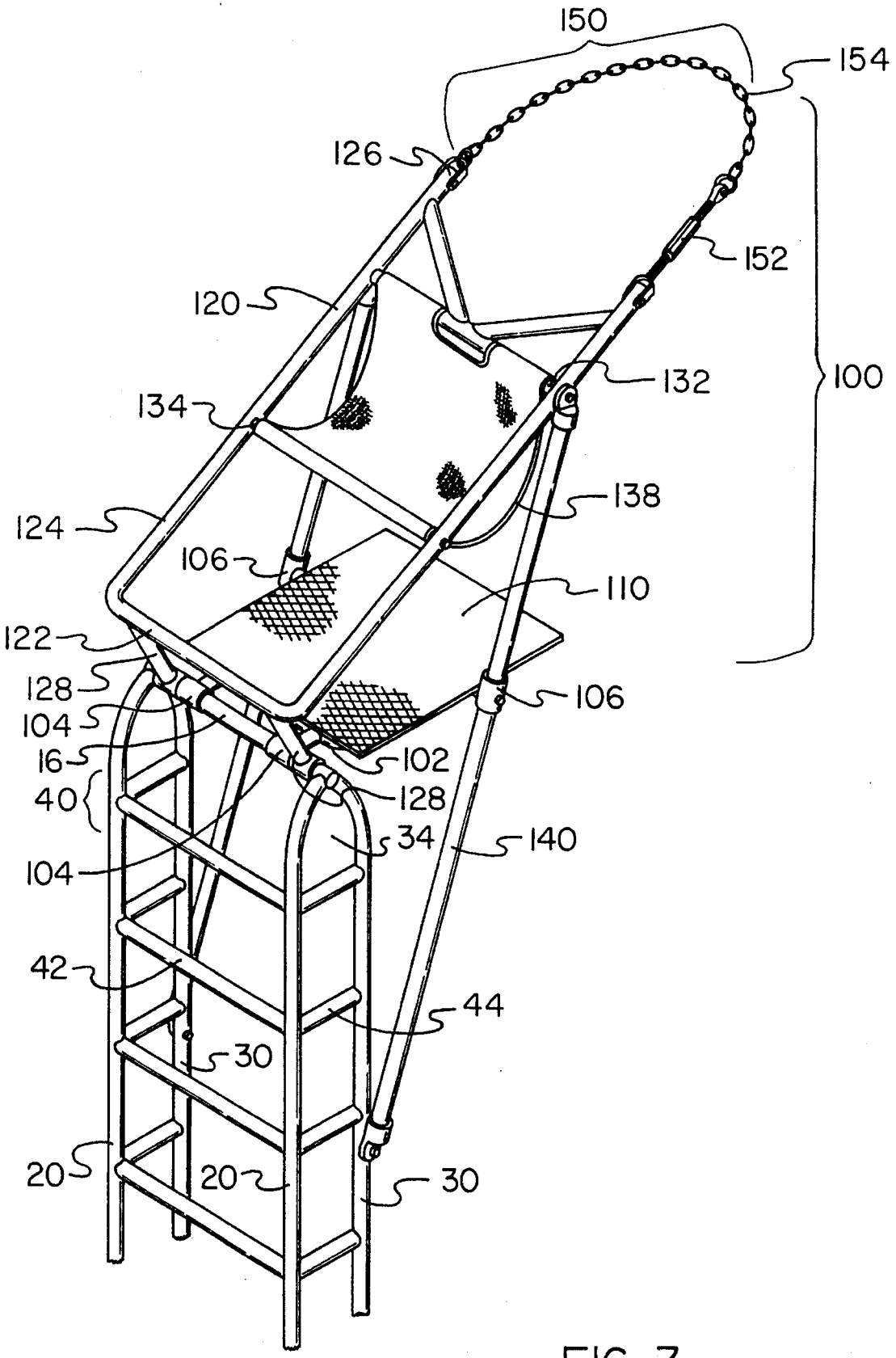
FIG. 3 is a perspective view of the present invention depicting the chair and upper section of the ladder.
Figure 4:
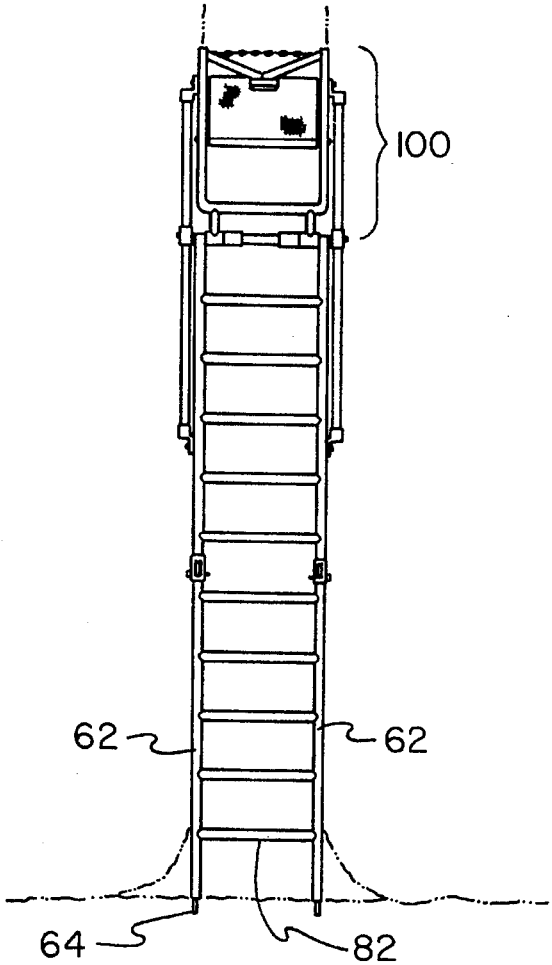
FIG. 4 is a yet another side-elevational view of the present invention secured to a tree and the ground therebelow in an operable configuration.
Figure 5:
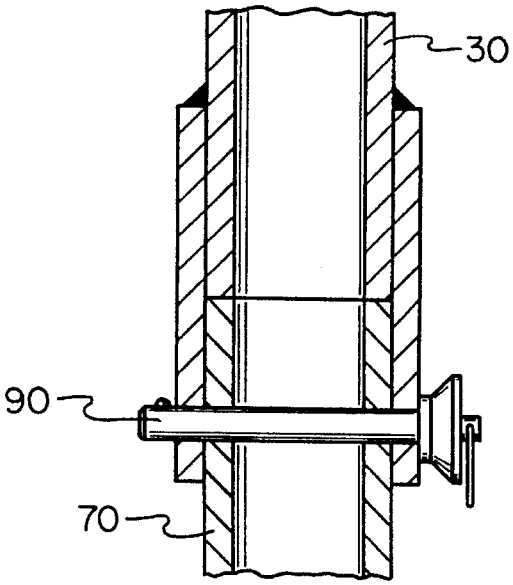
FIG. 5 is an enlarged cross-sectional view of the coupling between the upper section and lower section of the ladder through use of quick disconnect pins.

With reference now to the drawings, and in particular, to FIG. 1 thereof, the preferred embodiment of the new and improved folding ladder tree stand embodying the principles and concepts of the present invention and generally designated by the reference number 10 will be described.

Specifically, the present invention essentially includes three major components. The major components are the ladder, chair, and coupling mechanism. These components are interrelated to provide the intended function.

More specifically, it will be noted in the various Figures that the first major component is the ladder 12. It is formed of an upper section and a lower section. The upper section 14 includes an elongated horizontal pivot rod 16 having a pair of free ends. The pivot rod defines the location where rotational coupling between the chair and ladder takes place. The ladder also includes a pair of front legs 20. Each front leg has a top end, a bottom end, and an intermediate portion therebetween. Each front leg further includes a top segment and a bottom segment. The top segment of each front leg is coupled to a separate free end of the pivot rod 16 and then extended angularly downwards therefrom to the intermediate location. The bottom segment of each front leg is extended vertically downwards from the intermediate location to the bottom end. The upper section of the ladder also includes a pair of back legs 30. Each back leg has a top end, a bottom end, and an intermediate location therebetween. The bottom end of each back leg has a pin hole 32 formed thereon. Each back leg further includes a top segment and a bottom segment. The top segment is coupled to a separate free end of the pivot rod 16 and extended angularly downwards therefrom to the intermediate location. The top segment of the back leg and corresponding top segment of the front leg thereby form a pointed arch 34. The bottom segment of each back leg is extended vertically downwards from the intermediate location to the bottom end. The upper section of the ladder also includes a plurality of spaced and horizontal rungs 40. Each rung has a major segment 42 coupled between the front legs 20. The major segments allow a hunter to climb up the ladder to the chair. Each rung also includes a pair of opposed minor segments 44. Each pair of minor segments is perpendicularly positioned with respect to a corresponding major segment. Each minor segment is coupled between a separate front leg 20 and a corresponding back leg 30 of the upper section. The minor segments add rigidity and stability to the legs of the upper section.

The ladder also includes a lower section 50. The lower section has a pair of spaced and vertical front legs 62. Each front leg has a top end and a bottom end. The bottom of each front leg end further includes a pin 64 extended downwards therefrom. This pin is adapted to be forced into a recipient surface such as ground for providing stability to the lower section. Each top end of each front leg 62 of the lower section is pivotally coupled to a separate bottom end of a front leg 20 of the upper section. In this configuration, the upper section is pivotable with respect to the lower section. The lower section also includes a pair of spaced back legs 70. Each back leg has a top end, a bottom end, and an intermediate location therebetween. The top end of each back leg further includes a pin hole 72 formed thereon. The bottom end of each back leg is coupled to a separate front leg 62 at a location directly above the pin 64. Each back leg also includes a top segment and a bottom segment. The top segment of each back leg is extended vertically downwards from the top end to the intermediate location. The bottom segment of each back leg is extended angularly downwards from the intermediate location to the bottom end. The lower section of the ladder also includes a plurality of spaced horizontal rungs 80. Each rung has a major segment 82 coupled between the front legs. The major segment allows a hunter to climb up the lower section to the upper section. Each rung also includes a pair of opposed minor segments 84. Each minor segment is perpendicularly positioned with respect to the major segment. Each minor segment is coupled between a separate front leg 62 and corresponding back leg 70. The minor segments add rigidity and stability to the legs of the lower section.

The ladder also includes a pair of quick-disconnect pins 90. The pins are insertable through the aligned pin holes 32, 72 of the two pairs of corresponding back legs of the upper section and the lower section. When the pins are inserted into the pin holes, the ladder is placed in an operable configuration. When the pins are removed from the pin holes, the upper section is positionable within proximity of the lower section for placing the ladder in a stowed configuration.

The second major component is the chair 100. The chair includes a horizontal lower frame 102. The lower frame has front, rear, and opposed sides. The frame further includes a first pair of collars 104 and a second pair of collars 106. Each collar of the first pair is extended outwards from the front of the lower frame and pivotally coupled to the pivot rod 16 of the ladder. This allows the frame to be pivoted with respect to the upper section of the ladder. Each collar of the second pair is extended outwards from a separate side. The chair further includes a rectangular platform 110. The rectangular platform is secured upon the lower frame. The platform is formed of an expanded metal material. The platform provides a supporting surface upon which a hunter may stand when hunting or scouting game.

The chair also includes a generally U-shaped upper frame 120. The upper frame has a cross leg 122 and a pair of long legs 124 extended angularly upwards therefrom. Each long leg is terminated at a free end 126. The upper frame further includes a pair of spaced collars 128. The collars are extended angularly downwards from the cross leg and pivotally coupled to the pivot rod 16 of the ladder.

The chair also includes a seat 130. The seat is formed of an upper seat segment 132 and a lower seat segment 134. Each seat segment is extended between the long legs 124 of the frame. The seat also includes a pair of support segments 136. Each support segment has one end coupled to the midpoint of the upper seat segment and the other end coupled to a long leg 124 of the upper frame. The support segments provide increased stability and rigidity to the seat structure. The seat also includes a generally rectangular canvas sheet. This canvas sheet is extended between the seat segments to thereby define a concave portion for sitting 138. In this position, the long legs act as handles for helping a hunter position himself on the seat or remove himself from the seat. The chair also includes a pair of spaced bracing segments 140. Each bracing segment has an upper end, a lower end, and an intermediate portion extended therebetween. The upper end of each bracing segment is removably coupled to a separate long leg 124 of the frame at a location adjacent to an upper seat segment 132. The lower end of each bracing segment is coupled to the upper section 12 of the ladder. The intermediate portion of each bracing segment is extended between the upper end and lower end and through a separate collar 106 of the second pair. The upper ends of the bracing segments are coupled to the frame to thereby place the chair in an operable configuration above the upper section of the ladder in a fixed position for use. The upper ends are decoupled from the frame such that the chair is collapsible positionable in proximity with the upper section of the ladder in a stowed configuration.

The third major component is the coupling mechanism 150. The coupling mechanism is used for securing the ladder and chair in combination to a tree. The coupling mechanism has an openable, pivotable turnbuckle 152 coupled to a free end 126 of the frame. The coupling mechanism also includes a chain 154. The chain has a first end extended from the turnbuckle and a second end pivotally coupled to the other free end of the frame in a closed loop configuration securable about a tree 156. The coupling mechanism is adapted to be coupled about a tree for placing the chair and ladder in an operable configuration for use. The coupling mechanism is also coupleable about the upper section and lower section of the ladder for securing the chair and ladder in their stowed configurations for transport.

In the preferred embodiment, the ladder is about 10 feet in length when in an operable configuration. The spacing between the rungs of the ladder is about 12 inches. The spacing between a front leg and adjacent rear leg of a section of the ladder is about 2 inches. The upper frame as measured from the cross leg to its free ends is about 4½ feet long. The distance from the concave portion of the seat to the bottom ends of the lower section of the ladder is about 12 feet. The width of the seat is about 12 inches. The length of each bracing segment is about 5 feet. The platform is about 15 inches wide by about 16 inches long. The length of the major segment of the rung is about 18 inches. In a stowed configuration, the present invention is about 6 feet 6 inches long. All components of the present invention are made of a light weight rigid material such as aluminum for allowing easy placement in both the operable and stowed configurations.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A folding ladder tree stand for providing a hunter an elevated stationary support for hunting comprising, in combination:

a ladder further comprising:

an upper section having an elongated horizontal pivot rod having a pair of free ends;

a pair of front legs each having a top end, a bottom end, an intermediate location therebetween, a top segment, and a bottom segment with the top segment coupled to a separate free end of the pivot rod and extended angularly downwards therefrom to the intermediate location and the bottom segment extended vertically downwards from the intermediate location to the bottom end;

a pair of back legs each having a top end, a bottom end with a pin hole formed thereon, an intermediate location therebetween, a top segment, and a bottom segment with the top segment coupled to a separate free end of the pivot rod and extended angularly downwards therefrom to the intermediate location, with the top segment of the back leg and the corresponding top segment of the front leg forming a pointed arch, and the bottom segment extended vertically downwards from the intermediate location to the bottom end; and a plurality of spaced horizontal rungs with each rung having a major segment coupled between the front legs and a pair of opposed minor segments each perpendicularly positioned with respect to the major segment and each coupled between a separate front leg and corresponding back leg;

a lower section having:

a pair of spaced and vertical front legs each having a top end and a bottom end with a pin extended downwards therefrom, each top end pivotally coupled to a separate bottom end of a front leg of the upper section;

a pair of spaced back legs each having a top end with a pin hole formed thereon, a bottom end coupled to a separate front leg at a location above its pin, an intermediate location therebetween, a top segment, and a bottom segment with the top segment extended vertically downwards from the top end to the intermediate location, and a bottom segment extended angularly downwards from the intermediate location to the bottom end; and a plurality of spaced horizontal rungs with each rung having a major segment coupled between the front legs and a pair of opposed minor segments each perpendicularly positioned with respect to the major segment and each coupled between a separate front leg and corresponding back leg; and a pair of quick-disconnect pins with the pins insertable through the aligned pin holes of two pairs of corresponding back legs of the upper section and the lower section for placing the ladder in an operable configuration and with the pins removable from the pin holes such that the upper section is positionable within proximity of the lower section for placing the ladder in a stowed configuration;

a chair further comprising:

a horizontal lower frame having front, rear, and opposed sides and further having a first pair of collars and a second pair of collars with each collar of the first pair extended outwards from the front and pivotally coupled to the pivot rod of the ladder and each collar of the second pair extended outwards from a separate side;

a rectangular platform secured upon the lower frame;

a generally U-shaped upper frame having a cross-leg and a pair of long legs extended angularly upwards therefrom and with each long leg terminated at a free end, the upper frame further having a pair of spaced collars extended angularly downwards from the cross leg and pivotally coupled to the pivot rod of the ladder;

a seat formed of an upper seat segment and a lower seat segment with each seat segment extended between the long legs of the frame, a pair of support segments with each segment having one end coupled to the midpoint of the upper seat segment and another end coupled to a long leg of the upper frame, and a canvas sheet extended between the seat segments to thereby define a concave portion for sitting; and a pair of spaced bracing segments each having an upper end removably coupled to a separate long leg of the frame at a location adjacent to an upper seat segment, a lower end coupled to the upper section of the ladder, and an intermediate portion extended therebetween and through a separate collar of the second pair, the upper ends of the bracing segments coupled to the frame to thereby place the chair in an operable configuration, the upper ends decoupled from the frame such that the chair is collapsible positionable in proximity with the upper section of the ladder in a stowed configuration; and a coupling mechanism having an openable pivotable turnbuckle coupled to a free end of the frame and a chain having a first end extended from the turnbuckle and a second end pivotally coupled to the other free end of the frame, the coupling mechanism adapted to be coupled about a tree for placing the chair and ladder in their operable configurations for use, the coupling mechanism coupleable about the upper section and lower section of the ladder for securing the chair and ladder in their stowed configurations for transport.

* * * * *